US007866841B2

(12) United States Patent
Bushee et al.

(10) Patent No.: US 7,866,841 B2
(45) Date of Patent: Jan. 11, 2011

(54) COMPACT FLASHLIGHT

(76) Inventors: Glenn Bushee, 1145 Franklin St., Duxbury, MA (US) 02332; Jonathan Neal, 4 Hawthorne Rd., Kingston, MA (US) 02364

( * ) Notice: Subject to any disclaimer, the term of this patent is extended or adjusted under 35 U.S.C. 154(b) by 0 days.

(21) Appl. No.: 12/586,932

(22) Filed: Sep. 30, 2009

(65) Prior Publication Data

US 2010/0066263 A1 Mar. 18, 2010

Related U.S. Application Data

(63) Continuation of application No. 12/075,930, filed on Mar. 14, 2008, now Pat. No. 7,604,371.

(51) Int. Cl.
*F21L 4/04* (2006.01)

(52) U.S. Cl. ..... 362/206; 362/205; 362/802; 200/60; 315/362

(58) Field of Classification Search ..... 362/205, 362/206, 802; 315/287, 362; 200/60
See application file for complete search history.

(56) References Cited

U.S. PATENT DOCUMENTS 7,604,371 B2 * 10/2009 Bushee et al. ..... 362/206
7,652,216 B2 * 1/2010 Sharrah et al. ..... 200/60
7,674,003 B2 * 3/2010 Sharrah et al. ..... 362/205

* cited by examiner

*Primary Examiner*—Stephen F Husar

(57) ABSTRACT

A flashlight is provided with an end cap which carries an axially-actuated switch for turning the flashlight on and off with a convenient one-handed operation. The switch is designed with a latching function and a mode selection function which can be cycled through high, low and strobed light outputs with a partial throw of the switch. Cut-out portions are provided in the end cap for guiding a user's finger toward the switch and away from the sidewalls of the end cap.

6 Claims, 3 Drawing Sheets

COMPACT FLASHLIGHT

CROSS REFERENCE TO RELATED APPLICATIONS

This application is a continuation application of prior application Ser. No. 12/075,930 filed Mar. 14, 2008 entitled Compact Flashlight, now U.S. Pat. No. 7,604,371, and which is incorporated herein by reference in its entirety

BACKGROUND AND SUMMARY

High intensity flashlights are commonly carried by police and other law enforcement agents to aid in illuminating dark locations and to serve as a form of self defense. A bright intense light can temporarily stun or disorient an attacker when the light is directed at the attacker's eyes. Civilian versions of these flashlights are currently available in various shapes and sizes.

Many of the commercially-available self defense or tactical flashlights adapted for civilian use are intentionally large, bulky and heavy so that they can also be used as a club for striking in self defense. While these flashlights work well, they are not particularly well adapted for use by women and children who tend to prefer smaller and lighter flashlights.

Although some flashlights have been designed with reduced size and weight, they tend to overlook certain operating or human factors that are common to women. One factor overlooked is the long fingernails commonly worn by women. It has been found that long fingernails tend to interfere with the housings surrounding on-off switches of the type used in self defense and tactical flashlights.

This interference is a particular problem on flashlights having rear end-cap switches which are bordered or surrounded by a rim. When the switch is depressed in an axial or longitudinal direction, a long fingernail tends to abut or snag against any rim or other structure around the switch. This can prevent proper operation of the switch and result in a damaged fingernail.

Although some flashlight end cap switches project rearwardly and outwardly from the end cap, these exposed switches are easily activated unintentionally when bumped or dropped. This can unknowingly turn on the flashlight and drain the battery or batteries.

To overcome these problems, a compact flashlight has been designed with clearance for fingernails when operating and end cap switch, yet provides a guard around the end cap switch to prevent accidental actuation of the switch. The body and end cap of the flashlight are ergonomically designed for easy and comfortable one-handed operation.

DETAILED DESCRIPTION OF THE EMBODIMENTS

Figure 1:
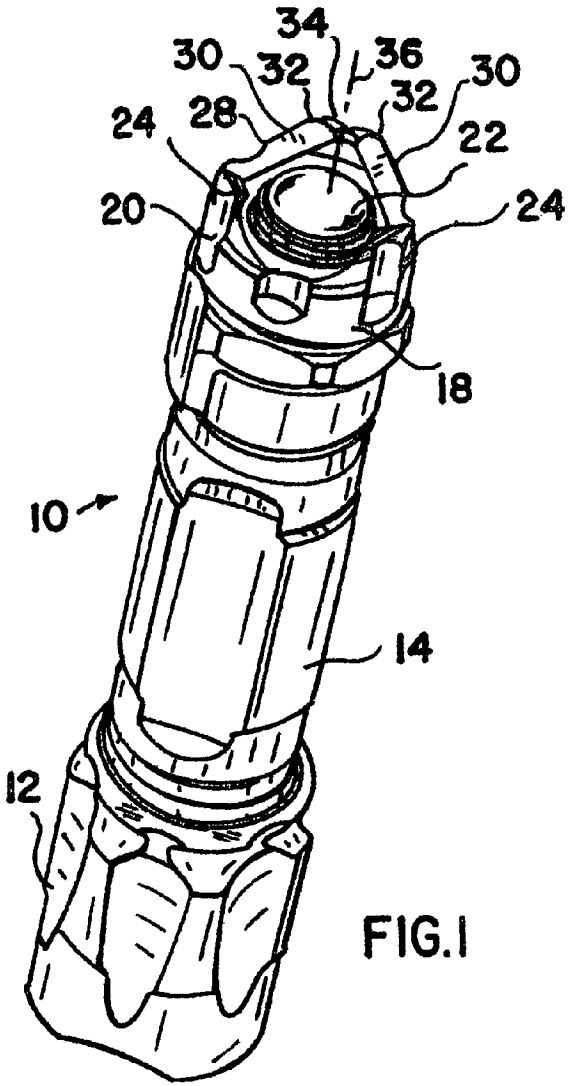
FIG. 1 is a rear perspective view of a first flashlight embodiment.
Figure 3:
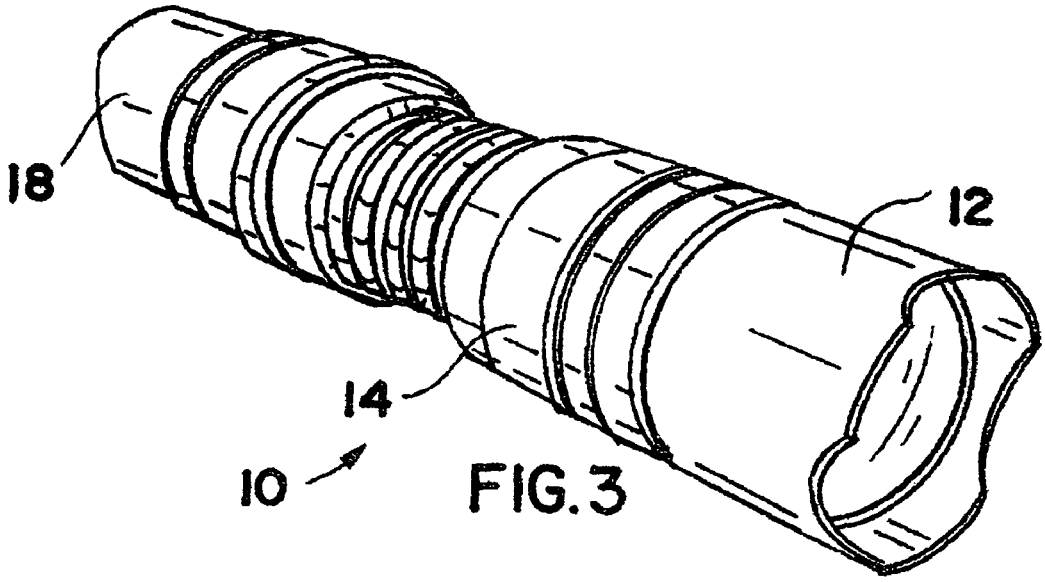
FIG. 3 is a front perspective view of a second flashlight embodiment.

A flashlight 10 shown in FIG. 1 includes a removable front crown 12 surrounding an axially-recessed lens covering a high intensity light-emitting-diode which provides an intense beam of light. The flashlight 10 further includes a tubular body 14 for housing one or more disposable or rechargeable batteries. A removable rear end cap 18 is threaded to the rear end of the tubular body 14.

Figure 2:
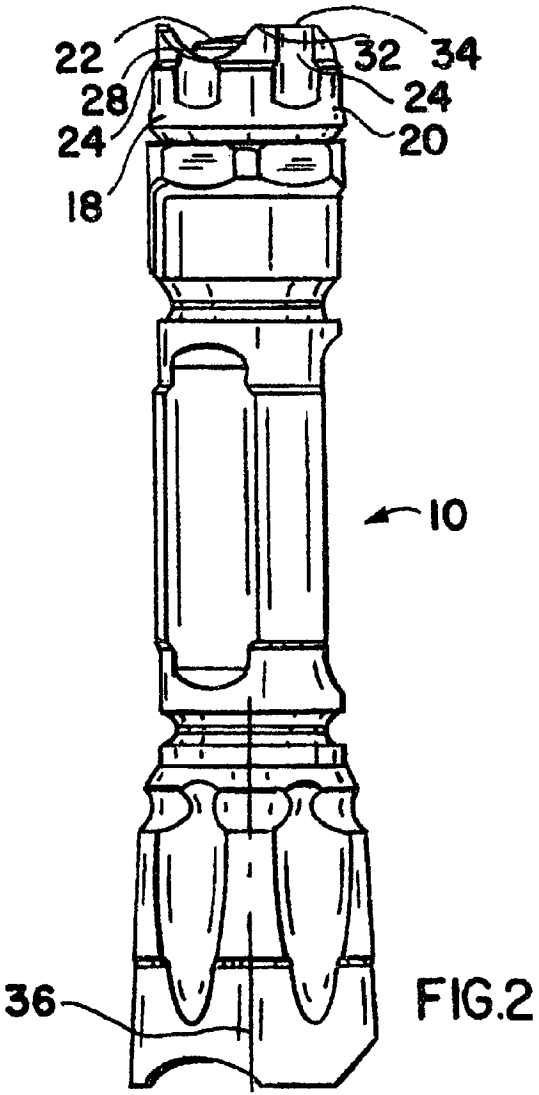
FIG. 2 is a side elevation view of FIG. 1.

The end cap 18 includes a sidewall 20 that surrounds a user-operated switch actuator 22 which is operated by movement along flashlight axis 36. As seen in FIGS. 1 and 2, the sidewall 20 is formed with three axially-rearweardly extending wall portions 24 which are symmetrically and circumferentially separated and spaced apart by three recesses, grooves or axial cut-out portions 28.

The grooves 28 in FIGS. 1 and 2 are formed as shallow U-shaped arcuate cuts or openings in the sidewall 20. The edges 30 of each groove 28 are formed as sharp chisel edges for use in self defense. The top of each groove 28 meets a sharp corner point 32 at the corner of each flat end surface 34 at the rear axial end of the wall portions 24.

The corner points 32 are useful for breaking glass, such as automobile window glass if needed to escape from inside a car or to free someone trapped inside a car.

As seen in FIG. 2, the switch actuator 22 is axially and radially recessed between and within the wall portions 24. The flat end portions 34 of the wall portions 24 can extend axially from several millimeters to a centimeter or more beyond the top end surface of the switch actuator 22. In this manner, the rearwardly-extending wall portions 24 protect the switch actuator 22 from unintended or accidental actuation, such as when the flashlight 10 is dropped or bumped.

The flat end surfaces 34 extend in a plane perpendicular to the longitudinally axis 36 of the flashlight 10 so that the flashlight 10 may be placed and remain upright on a flat surface in an on or off condition. This can free both of an operator's hands to work on overhead areas illuminated by the upright standing flashlight 10.

The cut-out portions or grooves 28 provide free finger or thumb access through the sidewall 20 to axially depress the switch actuator 22 and thereby operate the flashlight 10 with one hand. While this arrangement works well for most users, some users with long fingernails can hit the sides or edges of the cut-out portions 28 or hit the flat end surfaces 34 with their fingernail. This can prevent full or adequate axial depression of switch actuator 22 and thereby prevent the desired operation of the flashlight 10, i.e., turning the flashlight on or off or cycling the flashlight through other modes of operation such as high beam, low beam and high strobed beam. Moreover, such unwanted interference can cause split or damaged fingernails and chipped fingernail polish.

In order to further minimize or eliminate this condition, the flashlight 10 of FIGS. 3-7 has been developed to provide free access to the switch actuator 22 while guiding a user's finger or thumb between a pair of opposed wall portions 24 and nesting the finger or thumb within a pair of diametrically opposed cut-out portions 28. In this embodiment the wall portions 24 and cut-out portions 28 are diametrically and symmetrically opposed on opposite sides of end cap 18.

Figure 4:
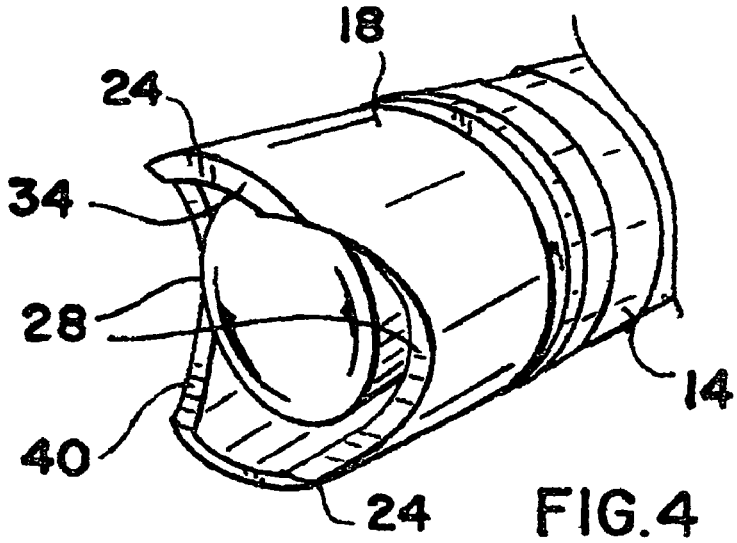
FIG. 4 is a partial rear perspective view of the end cap of FIG. 3.
Figure 5:
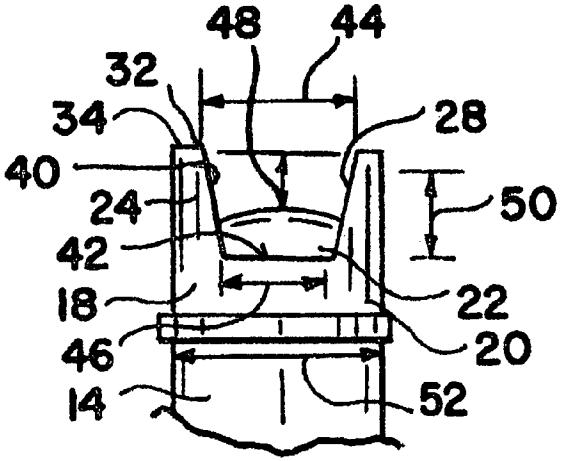
FIG. 5 is a side elevation view of FIG. 4.

As seen in FIG. 5, the end cap 18 can be formed with flat end surface portions 34 for placing the flashlight 10 upright on a flat horizontal surface. The side edges 40 of the cut-out portions 28 taper or converge axially forwardly and terminate at a flat horizontal floor portion 42 in sidewall 20, or terminate at a curved floor portion as shown in FIG. 4.

The mouth or opening distance 44 between the corners 32 should be about 1.5 to 2.0 centimeters to comfortably accept a finger or thumb tip. The width 46 across the floor portion can be about 1.0 to 1.5 centimeters to nest one's finger or thumb comfortably in each cutout portion 28 and snugly against their side edges 40. The tapered side edges 40 tend to center and guide one's finger or thumb onto the switch actuator 22.

The switch actuator 22 can be recessed a distance 48 (FIG. 5) below the flat surfaces 34 by two to six millimeters, preferably about three or four millimeters. The axial depth 50 of the cut out portions 28 can be about four to eight millimeters, preferably about four or five millimeters. The overall length of flashlight 10 can be anywhere from about 9 centimeters to about 15 centimeters or more with a diameter or width 52 of about 1.5 centimeters to 2.5 centimeters. These dimensions will provide a lightweight compact flashlight that can be easily operated with one hand.

Figure 6:
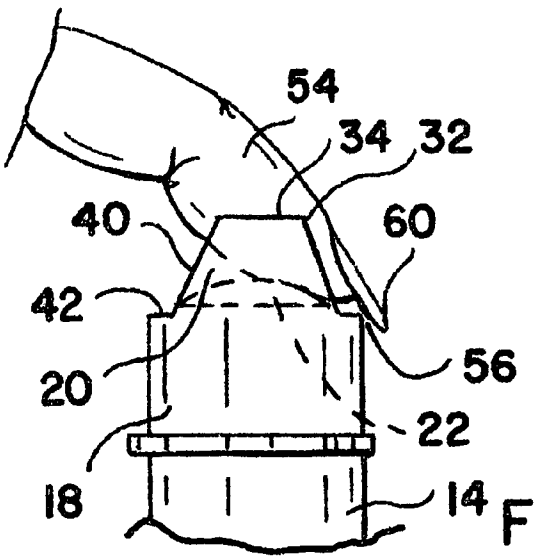
FIG. 6 is a view of FIG. 5 rotated 90 degrees and schematically showing the position of an operator's index finger.

As shown in FIG. 6, a user's index finger 54 can fully and easily depress the switch actuator 22 while maintaining a safe margin of clearance 56 with the floor 42 of recessed cut-out portion 28 of sidewall 20. The user's long fingernail 60 is directed away from any portion of the sidewall 20 by the recesses 28 which direct the fingernail outwardly and away from the sidewall 20, side edges 40 and floor 42.

Figure 7:
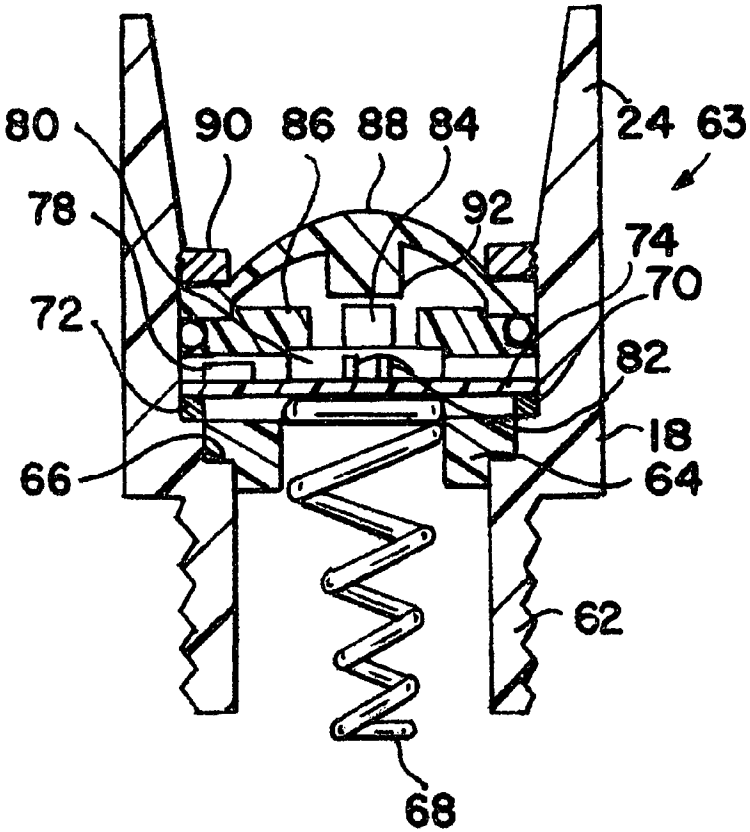
FIG. 7 is a central axial sectional view through a representative end cap of the type shown in FIGS. 3-6.

Details of a representative end cap assembly 63 are shown in FIG. 7. End cap 18 can be formed of an aluminum alloy, as can the remainder of the flashlight body 14 and front crown 12. A threaded collar 62 is provided on end cap 18 for threaded removable engagement and electric continuity with the tubular body 14.

The endcap assembly 63 includes a plastic insulating collar 64 which seats on a radial ledge 66 and receives a metal conical compression spring 68 which biases against and makes electrical contact with a battery housed within the tubular body 14. A copper wave washer 70 seats on a second radial ledge 72 and makes electrical contact with the aluminum end cap 18.

A circular circuit board 74 has conducting lands on its undersurface which make electrical contact with the spring 68 and with the end cap 18 through the wave washer 70. The circuit board 74 can be provided with one or more integrated circuits or "chips" including micro logic circuits 78 that can control the operation of the flashlight 10 as discussed below.

A conventional button switch 80 includes a rectangular or box-shaped housing. A pair of electrical leads 82 extending outwardly from within the housing interconnect internal button switch terminals within the switch housing with circuits and control logic on circuit board 70. A spring-biased plunger 84 completes contact between the electrical leads 82 when the plunger is axially depressed.

A plastic platform 86 seats on top of the button switch housing and provides a support surface for a dome-shaped resilient elastomeric diaphragm 88. An externally-threaded washer 90 mates with an internal threaded portion of end cap 18 to clamp and hold the perimeter of diaphragm 88 in fixed axial position. The diaphragm 88 includes a movable plunger portion 92 which is coaxially aligned with the plunger 84 on the button switch 80.

A light-activated luminescent material or a light-emitting material may be added to the elastomeric material of the diaphragm 88 to provide a "glow-in-the-dark" function. This facilitates locating and operating the diaphragm 88 in the dark.

When a user depresses the diaphragm 88, the plunger 92 on the diaphragm depresses the plunger 84 on the button switch 80 and completes an electrical circuit across electrical leads 82. This allows electrical current to flow through the circuits and logic components 78 on circuit board 74 via metal spring 68 which makes electrical contact with a land on the underside of circuit board 74. The circuit is completed through the battery or batteries, through the LED's and through the body of the flashlight and wave washer 70 and back to the circuit board 74.

Each time the button switch is pushed, the logic circuits 78 can be programmed to step the operation of the flashlight in virtually any desired sequence. For instance, the logic can operate as a simple alternating on-off switch which latches on or off each time the plunger 84 is fully depressed through a full axial throw.

Alternatively, the logic circuits 78 can be programmed to operate the flashlight in a sequence of high or bright light when the flashlight is first switched on, followed by a low or dull light when the plunger 84 is depressed again, and then off when the plunger is pressed a third time. In each case in this example, the functions of high, low and off are each maintained in a latched state until switched to the next function.

A rapidly pulsing or strobed lighting function can be easily provided to the function-switching sequences on either a high or low intensity setting by programming a timing and switching function in logic circuits 78. In this case a user could select from high, high strobe, low or low strobe, each in a latched state.

Another option is to provide lighting functions with a conventional latched on and latched off function in combination with high, low and strobe light functions. This can be achieved by turning on the flashlight with a relatively long axial depression or axial throw of the plunger 84 to latch the flashlight on. Smaller or shorter axial depressions or axial throws of plunger 84 can provide pulses to the logic circuits 78 to scroll through any desired sequence of operations until the plunger is again fully depressed and latched off.

For example, with the flashlight off, a user can latch on the flashlight 10 in a high-intensity mode by strongly pressing the diaphragm 88 through its full range travel and releasing it. The high intensity light beam will stay on until the user either strongly depresses the diaphragm 88 through its full length of axial travel or until the user lightly depresses and releases the diaphragm through a short stroke or depression of diaphragm 88. This short stroke and release will switch the light into a low intensity light beam output mode until the user fully and strongly depresses the diaphragm 88 again to turn the flashlight off, or again lightly depresses and releases the diaphragm 88 to switch to a strobe light output mode where the flashlight emits pulsed bursts of high intensity light beams.

The strobe mode will remain strobing until the operator fully depresses and releases the diaphragm 88 to turn off the flashlight or lightly depresses and releases the diaphragm 88 to cycle the function back to the high intensity light mode. In any mode of operation, the diaphragm 88 can be depressed and lightly held in a depressed condition without latching and thereby turn off the flashlight as long as the operator holds the diaphragm down. Upon releasing the diaphragm, the flashlight will return to its previous mode of operation. Alternatively, the circuit 78 will cycle the flashlight to a new mode of operation.

All of the above functions are conveniently provided by the microchip or control chip 78 in combination with the operation of the button switch.

There has been disclosed heretofore the best embodiment of the invention presently contemplated. However, it is to be understood that various changes and modifications may be made thereto without departing from the spirit of the invention.

What is claimed is:

1. A method of operating a flashlight having a plurality of operating modes including a high intensity light mode, a low intensity light mode and a strobe light mode, the flashlight having a user-operated switch having a long throw latching the flashlight on and off and a shorter throw cycling the flashlight through one or more of the plurality of operating modes, and logic circuits responsive to the switch and providing a selection of any one of the plurality of operating modes, wherein said method comprises:

turning on the flashlight with a first long throw and release of the switch and latching the flashlight on in a high intensity light mode with the long throw and release of the switch;

providing a first electrical pulse to the logic circuits with a short throw and release the switch;

switching from the high intensity light mode to a low intensity light mode with the first electrical pulse;

providing a second electrical pulse to the logic circuits with a short throw and release of the switch; and switching from the low intensity light mode to a strobe light mode with the second electrical pulse.

2. The method of claim 1, further comprising providing a third electrical pulse to the logic circuits with a short throw and release of the switch; and switching from the strobe light mode to the high intensity light mode with the third electrical pulse.

3. The method of claim 1, further comprising turning off the flashlight by switching from any one of the high intensity light mode, the low intensity light mode, and the strobe light mode with a second long throw of the switch.

4. A method of operating a flashlight having a plurality of operating modes including a high intensity light mode, a low intensity light mode and a strobe light mode, the flashlight having a user-operated switch having a long throw for latching the flashlight on and off and a shorter throw cycling the flashlight through one or more of the plurality of operating modes, and logic circuits responsive to the switch and providing a selection of any one of the operating modes, wherein the method comprises:

turning on the flashlight with a first long throw and release of the switch and latching the flashlight on in a first mode of the plurality of operating modes with the long throw and release of the switch;

switching from the first mode to any one of the remaining plurality of operating modes with one or more short throws and releases of said switch; and turning off the flashlight in any one of the plurality of operating modes with a second long throw and release of the switch.

5. The method of claim 4, wherein the long throws of the switch are achieved with a strong switch depressing force and the short throws of the switch are achieved with a light switch depressing force, and wherein the method further comprises switching the flashlight on with a long throw and release of the switch and with a strong switch depressing force to turn the flashlight on in a first one of the operational modes and switching to a second one of the operational modes with a short throw and release of the switch and with a light switch depressing force less than the strong switch depressing force.

6. A method of operating a flashlight having a plurality of operating modes including a high intensity light mode, a low intensity light mode and a strobe light mode, the flashlight having an axially-movable switch actuator provided on an axial end portion of the flashlight, the switch actuator configured for operation with a single finger or thumb, the flashlight having a user-operated switch coupled to logic circuits which provide a serial cyclic selection of any one of the operating modes in response to a serial actuation of the switch, and wherein the method comprises:

turning on the flashlight in one of the plurality of modes with a first axial throw of the switch by applying a first axial force to the switch actuator with a finger or thumb;

selecting another operating mode with a second axial throw of the switch by applying a second axial force to the switch actuator with a finger or thumb; and wherein the first axial throw is longer than the second axial throw and the first axial force is greater than the second axial force.

* * * * *